United States Patent [19]

Stewart

[11] 4,280,613

[45] Jul. 28, 1981

[54] TIE PLATE CONVEYING AND ORIENTATING SYSTEM

[75] Inventor: John K. Stewart, Lexington, S.C.

[73] Assignee: Canron Corp., West Columbia, S.C.

[21] Appl. No.: 84,303

[22] Filed: Oct. 12, 1979

[51] Int. Cl.[3] ..... B65G 47/24

[52] U.S. Cl. ..... 198/406; 104/16; 198/445; 198/456

[58] Field of Search ..... 104/2, 5, 6, 16, 17 A, 104/17 R; 198/406, 445, 456, 457, 458, 560, 569, 601; 193/36

[56] References Cited

U.S. PATENT DOCUMENTS

| | | | |
|---|---|---|---|
| 1,089,537 | 3/1914 | Crum | 193/36 |
| 2,775,334 | 12/1956 | Jeremiah | 198/406 X |
| 3,701,320 | 10/1972 | Fearon et al. | 104/6 |
| 4,043,443 | 8/1977 | O'Brien | 198/445 X |
| 4,193,489 | 3/1980 | Siniscal | 198/406 |

*Primary Examiner*—James L. Rowland

*Attorney, Agent, or Firm*—Alfred L. Patmore, Jr.

[57] ABSTRACT

A system including method and apparatus for conveying and orientating tie plates for use with a railway track renewal or construction machine designed to run along a railway track. The system provides a delivery of tie plates to mechanisms for positioning and laying the plates on new or reconditioned ties adjacent both ends of each tie with the field side of the tie plate facing outwardly. A first longitudinally directed power driven conveyor is located centrally with its inlet end in a gondola car used to store the tie plates. This conveyor is divided along its longitudinal center by a wall to provide a means for conveying two adjacent lines of tie plates. The tie plates are introduced to this first conveyor on both sides of the dividing wall with the plates facing upward and the field end of the plates facing forward. A pair of second longitudinally directed power driven conveyors are located on the track working machine downstream of and outwardly from the first conveyor and at a lower level. Two undriven curved roller conveyors are arranged to receive one each of the lines of plates from the exit end of the first driven conveyor and to deliver the plates transversely outward and downward to separate ones of the two second power driven conveyors for delivery to the laying mechanisms.

7 Claims, 2 Drawing Figures

TIE PLATE CONVEYING AND ORIENTATING SYSTEM

BACKGROUND OF THE INVENTION

1. Field of the Invention

The subject invention relates to means for continuously conveying and orientating tie plates for use on or with track working vehicles which either renew railway track by replacing rails and either refurbishing ties or replacing ties, or on track working vehicles which construct new track in a continuous manner. In any event, there is a need for continuous delivery of tie plates from a storage or salvage area to mechanisms for laying the tie plates on the ties adjacent to both ends for each tie with the rail engaging side of the plate facing upward.

As is well known in the art, the rail seat of a conventional tie plate is canted inwardly 1/40 to 1/20 and more mass is put in the field side of the plate to compensate for the force distribution as it exists in going around curves at high speed. This imposes the additional requirement that the tie plates be delivered to the laying mechanism with the field side of the plate facing outward.

Examples of track working machinery which automatically and continuously replace old rail with new heavier rail and replace tie plates while continuously refurbishing the ties as by cribbing, adzing, creosoting, and filling old spike holes are shown in pending applications, Ser. Nos. 899,969 and 951,133 directed to high speed rail changeout machines. An example of a track renewal machine which completely replaces the ties and to which the present invention can be applied, is shown in British Pat. No. 1,339,842.

2. Description of the Prior Art

In early attempts to automate or provide equipment to work in a semi-continuous fashion, it was common to group railway cars together to perform individual tasks that previously had been performed completely by work gangs in a manual manner. An example of such a system is shown in U.S. Pat. No. 1,941,930 issued Jan. 2, 1934. While some of the functions such as adzing were performed in a semi-automatic manner by such devices, clearly the laying of new tie plates on the ties was a manual operation by distributing the tie plates from cars containing them along the right of way and then the placement of the tie plates on the ties. Even with more recent developments in track renewal, some of which embraced partial conveying of the new tie plates to a manual work station as shown in U.S. Pat. No. 3,286,648 and U.S. Pat. No. 3,747,536, the final placement and proper orientation and positioning was a manual operation.

With the advent of high speed automatic machinery as shown in the aforementioned co-pending patent applications, Ser. Nos. 899,969 and 951,133, automation of the tie plate handling became a necessity. Equipment for automatically taking up old tie plates and delivering plates back to ties in the proper position is shown in co-pending U.S. patent application, Ser. No. 951,130. An early attempt to solve the tie plate conveying and orientation problem for use with this equipment took the form of a more or less conventional cross-transfer conveying system.

With the conventional cross-transfer system, the tie plate orientation is determined at the point the tie plates are first put on a conveyor, e.g., at a storage location in an upstream gondola car. A first conveyor or series of conveyors would be power driven to convey a single line of tie plates longitudinally of the cars to the track working vehicle. The plates would be put on the conveyor system and be conveyed in a side-by-side relationship, i.e., with the tie plate ends parallel with the railway track. The cross-transfer mechanism is preferably located on the track working vehicle and is operated to push successive plates alternately outward toward the right hand rail and the left hand rail locations. Since the field side of the plate must face outwardly from the center of the railway track and the gauge side must face inwardly, the plates are placed on the first conveyor with the ends of adjacent plates pointing in opposite directions. The cross-transfer mechanism will thus transfer the tie plates from a single row, first longitudinal driven conveyor to two single row, second longitudinal conveyors which will be generally in line with and feed the right hand and left hand mechanisms for positioning and laying the tie plates adjacent each end of each tie for reception of new rails.

The foregoing conventional cross-transfer conveying system has many limitations, particularly as applied to a high speed track renewal or construction machine, such as the rail changeout machines set forth in the aforementioned pending patent applications. This machine can automatically and continuously replace old rail with new, heavier rail, replace tie plates and continuously refurbish the ties as by cribbing, adzing, creosoting and filling old spike holes. Moreover, this machine can operate at speeds of 2400 ft./hr. which virtually exceeds the rate at which a cross-transfer conveying system can operate. At this speed, close to 3,000 tie plates must be delivered per hour which virtually exceeds the capacity of a single row longitudinal conveyor. The difficulty of synchronizing the initial loading of the tie plates also becomes more complex as speed is increased. This can be illustrated by the problem of employing four laborers in a gondola car to load the conveyor. Since the plates must be staggered as aforementioned, the four men must simultaneously drop the plates on the conveyor in less than five seconds, and with a 25 lb. plate, each man must handle approximately 150,000 lbs. per 8 hour shift.

SUMMARY OF THE INVENTION

A tie plate conveying and orientation system of the instant invention eliminates the cross-transfer mechanism with all of its complexity and its restriction in use to a single line conveyor. Likewise, the present invention eliminates the requirement for synchronized loading of staggered tie plates. This latter advantage allows for the use of any number of laborers who merely introduce the tie plates facing in one direction. Of course, the initial loading may be further automated by the use of a far simpler magazine that does not require staggered loading.

A first longitudinally directed power driven conveyor is located centrally on a gondola car used to store or salvage the tie plates. This conveyor is divided along its longitudinal center by a wall or baffle to provide a means for delivering two adjacent lines of tie plates toward the tie plate laying mechanism. The tie plates are introduced to this first conveyor on both sides of the dividing wall with the rail engaging faces of the plates facing upward and the field ends of the plates facing forward. One or more of these conveyors can be serially aligned to convey the plates through one or more gondola cars to the track working machine, and intermedite undriven roller sections or the like may be pivotally mounted to transfer the plates between the serially aligned driven conveyor sections.

A pair of second longitudinally directed power driven conveyors are located on the track working machine downstream of and outwardly from the first conveyor and at a lower level. Two undriven curved conveyors are arranged to receive one each of the lines of plates from the exit end of the first driven conveyor and to deliver the plates transversely outward and downward to separate ones of the two second power driven conveyors for delivery to the plate laying mechanisms. Preferably, the two undriven curved conveyors take the form of roller conveyors and these rolls ideally can be tapered outwardly from the inside of the curve to the outside of the curve. The curved roller conveyors can also take the form of a helical descent or a circular descent in a common plane.

Preferably, a second, straight, undriven roller conveyor overlies the inlet end of each of the second power driven conveyors so as to be in line with the exit end of the curved roller conveyors with the rolls of these roller conveyors being located transversely to the second power driven conveyors so as to be in the path of delivery from the curved roller conveyors to the second power driven conveyors. The second roller conveyor spans a portion of the vertical distance between the first and second driven conveyors between the curved roller conveyor and the second driven conveyor. Advantageously, a stop can be associated with the second undriven roller conveyor for stopping the forward movement of the tie plates exiting from the curved roller conveyor onto the second roller conveyor. Likewise, a guide may be associated with the forward end of the second roller conveyor and generally parallel to the rolls thereof for guiding the tie plates in their movement from the curved conveyor to the stop. A guide would be spaced a sufficient distance above the rolls at the exit end of the second roller conveyor to permit tie plates to pass thereunder from the second roller conveyor onto the second longitudinally directed power driven conveyor.

DETAILED DESCRIPTION OF THE PREFERRED EMBODIMENT

Figure 1:
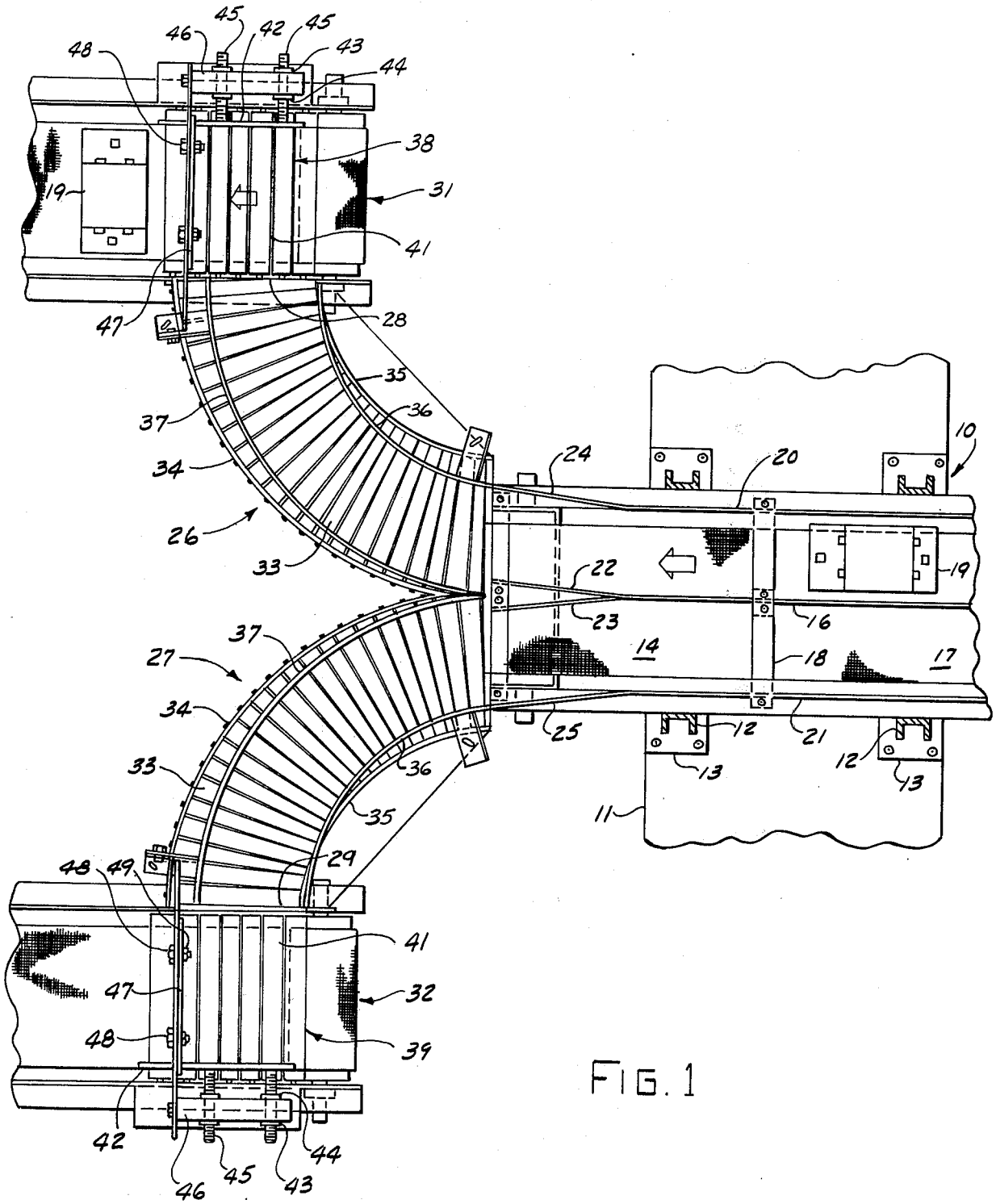
FIG. 1 is a plan view of a preferred embodiment of the invention.
Figure 2:
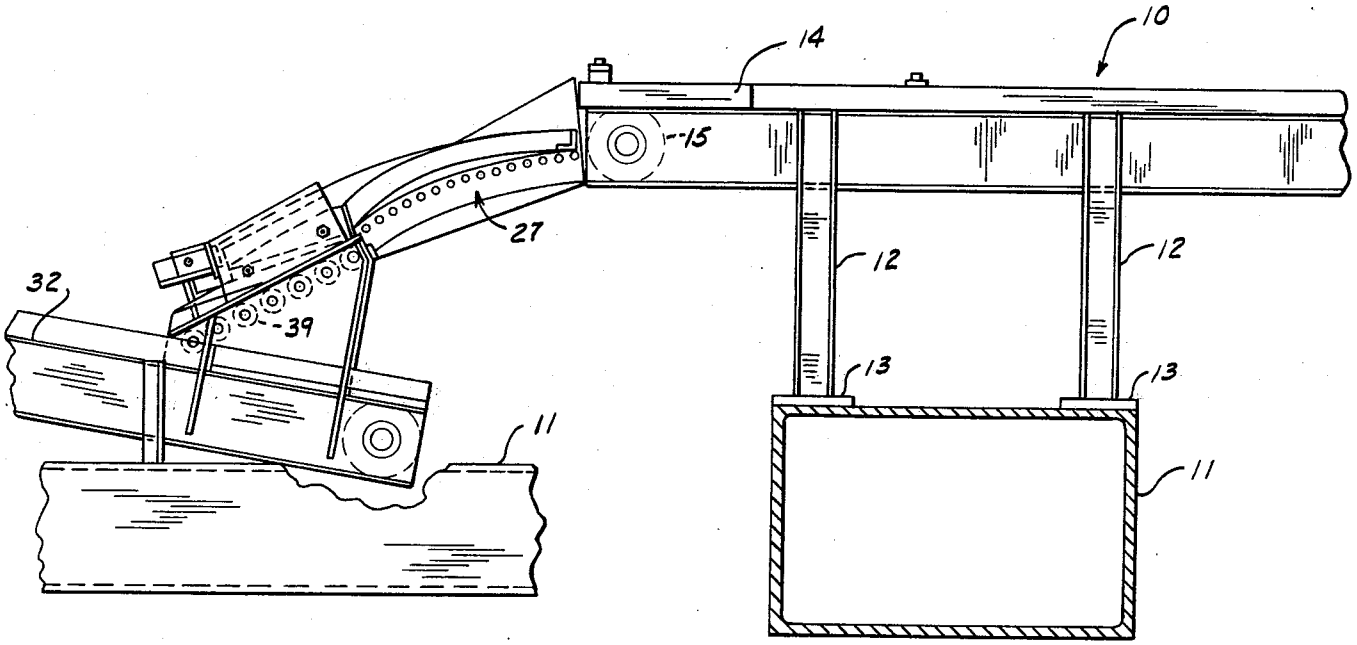
FIG. 2 is a side elevation of the preferred embodiment shown in FIG. 1.

As shown in the drawings, item 10 is a continuous driven belt conveyor which is mounted to the main frame 11 of a track working vehicle, such as those described in the aforementioned co-pending patent applications, as by channels 12 and plates 13. Only the forward end 14 of this conveyor is shown, trained around drum 15 which may be the driven drum. As in the aforementioned patent applications, where it is desirable to use a heavier rail, thus necessitating the use of new tie plates, these tie plates will be stored in one or more gondola cars, each of which will require a similar driven conveyor 10 as well as pivoted conveyors (not shown) between successive gondola cars, and between the last gondola car and the track working machine. Continuous conveyor 10 is divided into two contiguous conveying paths by wall or baffle 16 which is supported above the belt surface 17 by support structure 18. Tie plates 19 are placed on both sides of the baffle 16 on belt 17 to form two continuous rows thereof with the sides of the plates parallel to the longitudinal extent of the conveyor and the dividing wall 16. As shown in FIG. 1, tie plate 19 is loaded on the conveyor with the field end F of the plate facing forward and the gauge end of the plate G facing the rear of the conveyor. Side walls or guides 20 and 21 may also be provided on conveyor 10 to restrict and guide the tie plates 19. At the forward or exit end 14 of conveyor 10 the central wall 16 is replaced by divergent guides 22 and 23 which co-act with divergent guides 24 and 25, which are a continuation of side walls 20 and 21, respectively. The forward motion of conveyor 10 in cooperation with guides 22 and 24 conduct the tie plates from the exit end 14 of the conveyor onto right hand undriven curved conveyor 26. Likewise, the forward motion of conveyor 10 in cooperation with guides 23 and 25 at the exit end 14 of the conveyor guide the second row of tie plates 19 onto left hand undriven curved conveyor 27. Curved conveyors 26 and 17 traverse a substantially circular path of approximately 90° from their inlet to exit ends ending at 28 and 29, respectively, adjacent to and transverse to the inside sides of second longitudinally directed power driven conveyors 31 and 32. Second longitudinally directed power conveyors 31 and 32 are downstream of and outwardly from the first longitudinally directed power driven conveyor 10. The exit ends 28 and 29 of curved conveyors 26 and 27 respectively are at a lower level than their inlet ends at the forward end 14 of conveyor 10. Thus, conveyors 26 and 27 may take the form of chutes delivering the tie plates from the end of conveyor 10 to the inlets of driven conveyors 31 and 32 by a combination of the inertia which they have leaving the ends of conveyor 10 and the gravity drop of conveyors 26 and 27. The plates would then be conveyed forwardly on conveyors 31 and 32 to the mechanisms for positioning and laying the tie plates on the ties.

In the preferred embodiment shown in the drawings, the curved conveyors 26 and 27 take the form of roller conveyors with the individual rolls 33 tapering outwardly from the inside of the curve 35 to the outside of the curve 34. Since the tie plates may vary in length from 11 to 18 inches and in width from 7 to 7½ inches, it is desirable to provide adjustable curved guides 36 and 37 on both the curved conveyors 26 and 27.

While the tie plates may satisfactorily be fed directly from curved conveyors 26 and 27 onto the second longitudinally directed power driven conveyors 31 and 32, it has been found desirable with ever increasing speeds of production to provide second undriven roller conveyors 38 and 39 overlying the inlet ends of second conveyors 31 and 32 respectively. These second undriven roller conveyors 38 and 39 are in line with the exit ends 28 and 29 of curved conveyors 26 and 27, respectively. The rolls 41 of second undriven roller conveyors 38 and 39 are transverse to the second longitudinally directed driven conveyors 31 and 32, and conveyors 38 and 39 slope downwards towards conveyors 31 and 32 respectively, so as to span a portion of the vertical distance between the first longitudinally directed power driven conveyor 10 and second longitudinally directed power driven conveyors 31 and 32 between curved roller conveyors 26 and 27 and the second power driven conveyors 31 and 32. Stops 42 are provided for stopping the forward movement of the tie plates 19 exiting from curved conveyors 26 and 27 onto their respective second undriven roller conveyors 38 and 39. The stops 42 are adjustable for tie plate length by adjustment of nuts 43 and 44 on studs 45 relative to support bar 46. Guides 47 are provided at the forward end of the second roller conveyors 38 and 39. These guides 47 are generally parallel to the rolls and provide guidance of the tie plates in their movement from curved roller conveyors 26 and 27 to stops 42. Guides 47 are adjustable by way of nuts 49 and bolts 48 so that the distance between the bottom of guides 47 and rolls 41 is just sufficient to allow the tie plates 19 to exit from second roller conveyors 38 and 39 onto the second longitudinally directed power driven conveyors 31 and 32.

In operation, ties plates 19 are placed on conveyor 10 on both sides of baffle 16 to provide two adjacent end-to-end rows of tie plates 19 with their field ends forward and their rail engaging faces facing upward. The tie plates pass on belt surface 17 between side wall 20 and center wall 16 and between side wall 21 and center wall 16 to the forward end 14 of conveyor 10. The tie plates on the right hand side of conveyor 10 then pass between guides 22 and 24 onto right hand undriven roller conveyor 26 riding on rolls 33 between curve guides 36 and 37 to the exit 28 to conveyor 26 and onto second undriven roller conveyor 38 guided by guide 37 until the plate hits stop 42. Tie plate 19 then passes under guide 47 and onto second driven longitudinally directed conveyor 31 where it is conducted to a mechanism for positioning and laying the tie plate on a tie. In a similar manner tie plates on the left hand side of conveyor 10 pass between guides 23 and 25 onto right hand undriven roller conveyor 27 to second undriven roller conveyor 39 and onto second driven longitudinally directed conveyor 31.

What I claim as my invention is:

1. For use with a railway track renewal or construction machine adapted to run along said railway track, apparatus for conveying and orientating tie plates for delivery to a mechanism for positioning and laying the tie plates on ties, comprising, in combination: a first longitudinally directed power driven conveyor for serially delivering tie plates from a storage area towards said mechanism, with the rail engaging side of the plates facing upward and the field end of the plates facing forward; a second longitudinally directed power driven conveyor longitudinally and vertically spaced downstream of said first conveyor; a curved conveyor at least partially spanning said longitudinal and vertical spacing arranged to receive tie plates from an end of the first power conveyor and to deliver said plates transverse to said second conveyor; and an intermediate conveyor overlying the inlet end of said second power driven conveyor in line with the exit end of said curved conveyor said intermediate conveyor spanning a portion of the vertical distance between said first and second driven conveyor between said curved conveyor and said second driven conveyor, whereby said tie plates are delivered from said first longitudinally directed power driven conveyor to said cured conveyor onto said intermediate conveyor to said second longitudinally directed power driven conveyor with the field side of said plates facing outwardly.

2. Apparatus according to claim 1 wherein said curved conveyor is a roller conveyor.

3. Apparatus according to claim 2 wherein said roller conveyor utilizes rolls tapered outwardly from the inside of the curve to the outside of the curve.

4. Apparatus according to claim 2 wherein said curved conveyor is an undriven roller conveyor.

5. For use with a railway track renewal or construction machine adapted to run along said railway track, apparatus for conveying and orientating tie plates for delivery to a mechanism for positioning and laying the tie plates on ties, comprising, in combination: a first longitudinally directed power driven conveyor for serially delivering tie plates from a storage area towards said mechanism, with the rail engaging side of the plates facing upward and the field end of the plates facing forward; a second longitudinally directed power driven conveyor longitudinally and vertically spaced downstream of said first conveyor; an undriven curved roller conveyor at least partially spanning said longitudinal and vertical spacing arranged to receive tie plates from an end of the first power conveyor and to deliver said plates transverse to said second conveyor; and a second undriven roller conveyor overlying the inlet end of said second power driven conveyor in line with the exit end of said curved roller conveyor with the rolls of said second roller conveyor being transverse to said second driven conveyor and said second roller conveyor spanning a portion of the vertical distance between said first and second driven conveyor between said curved roller conveyor and said second driven conveyor, whereby said tie plates are delivered from said first longitudinally directed power driven conveyor to said undriven curved roller conveyor onto said second roller conveyor to said second longitudinally directed power driven conveyor with the field side of said plates facing outwardly.

6. Apparatus according to claim 5 further comprising a stop associated with said second undriven roller conveyor for stopping the forward movement of the tie plates exiting from said curved roller conveyor onto said second roller conveyor.

7. Apparatus according to claim 6 further comprising a guide means associated with forward end of said second roller conveyor and generally parallel to the rolls thereof for guiding the tie plates in their movement from said curved roller conveyor to said stop, said guide means being spaced a sufficient distance above the rolls at the exit end of said second roller conveyor to permit tie plates to pass thereunder from said second roller conveyor onto said second longitudinally directed power driven conveyor.

* * * * *